United States Patent [19]

Haneda et al.

[11] Patent Number: 4,607,933

[45] Date of Patent: Aug. 26, 1986

[54] METHOD OF DEVELOPING IMAGES AND IMAGE RECORDING APPARATUS UTILIZING SUCH METHOD

[75] Inventors: Satoshi Haneda; Seiichi Hiratsuka, both of Hachioji, Japan

[73] Assignee: Konishiroku Photo Industry Co., Ltd., Tokyo, Japan

[21] Appl. No.: 628,329

[22] Filed: Jul. 6, 1984

[30] Foreign Application Priority Data

Jul. 14, 1983 [JP] Japan ..... 58-128895
May 8, 1984 [JP] Japan ..... 59-90284

[51] Int. Cl.[4] ..... G03G 15/08

[52] U.S. Cl. ..... 355/3 DD; 355/14 D; 118/688; 118/663; 118/657; 430/30; 430/35; 430/122

[58] Field of Search ..... 355/3 DD, 14 D, 3 R, 355/1; 118/688, 663, 668, 657; 430/122, 120, 30, 35

[56] References Cited

U.S. PATENT DOCUMENTS 4,111,152 9/1978 Sakamoto ..... 118/688
4,313,671 2/1982 Kuru ..... 355/3 DD X
4,372,672 2/1983 Pries ..... 355/3 DD X
4,378,158 3/1983 Kanbe ..... 355/3 DD
4,449,810 5/1984 Ikesue et al. ..... 355/3 DD
4,451,134 5/1984 Fukuchi et al. ..... 355/3 DD
4,478,505 10/1984 Tashiro ..... 355/3 DD
4,496,644 1/1985 Ateya et al. ..... 355/3 DD X
4,511,240 4/1985 Suzuki et al. ..... 355/14 R

*Primary Examiner*—A. C. Prescott
*Attorney, Agent, or Firm*—Jordan B. Bierman

[57] ABSTRACT

A method of developing electrostatic latent images in a recording apparatus by forming a layer of developer containing toner particles on a conveying means, the thickness of said layer being smaller than the space existing between the image forming surface and the conveying means. The developer is transferred to the image forming surface by an alternating bias voltage. A detecting means determines the toner concentration in the developer; and the developer conditions are controlled in response to the detection of the toner concentration so that image density remains substantially constant despite change in toner concentration.

14 Claims, 15 Drawing Figures

METHOD OF DEVELOPING IMAGES AND IMAGE RECORDING APPARATUS UTILIZING SUCH METHOD

BACKGROUND OF THE INVENTION

1. Field of the Invention

This invention relates to a method of developing images in which a developer containing carriers and toners is supplied from a developer reservoir to the surface of a developer conveyor so that a developer layer can be formed, and the toners are flown from the developer layer formed on the conveyor by utilizing the application of a bias voltage so that an electrostatic latent image formed on the surface of an image forming body can be developed; and this invention also relates to an image recording apparatus utilizing the abovementioned method.

2. Description of the Prior Art

Magnetic brush developing methods are already known, in which an electrostatic latent image is developed by making use of such a developer as is so-called two-component type developer containing magnetic carrier particles and toner particles, also if necessary, a small amount of hydrophobic silica and the like, and by bringing a developer layer formed on a developer conveyor (hereinafter called as a sleeve, for convenience.) into contact with the surface of an image forming body (hereinafter called as a photoreceptor, for convenience.); and electrostatic recording apparatuses including electrophotographic copying apparatuses are also already known, in which the abovementioned methods are utilized respectively. In these methods and apparatuses, however, there are instances where an image density is lowered in a low toner-concentration and a non-image produced area is soiled with fog in a high toner-concentration, even if the requirements for forming an image such as a D.C. bias voltage to be applied to a sleeve are adjusted at the time when the toner concentration of a toner developer was varied in the developer reservoir of a developing unit. There is also a limit to keep a proper toner concentration, that is, 3 to 10% by weight thereof to the total amount of developer. Hereinafter, the proportion of toner to developer will be called as a toner concentration, because it will be expressed as a percentage by weight.

In the meantime, when utilizing a developing method under non-contact conditions in which toner is flown from a developer layer laid on a sleeve in a vibrating-electric field to the surface of a photoreceptor so as to be adhered thereto without bringing the developer layer into contact with the surface of the photoreceptor, then it can clearly be proved by a lot of experiments that the density of image developed is varied according to the concentration of toner in developer as seen in FIG. 1.

In FIG. 1, it is found that the density of image developed, that is, the density of image recorded, tends to be increased with the increase of the concentration of toner when the concentration of toner in developer is in a relatively lower range, and reversely the density of image developed tends to be decreased when the concentration of toner is excessively increased. It may be estimated that the phenomenon that the density of an image developed is decreased may be caused by not satisfactorily charging toners stored in a developer reservoir when the concentration of toner is excessively increased. In other words, it may be estimated that the phenomenon may be caused by the decrease of the proportion of the toner which is satisfactorily charged. The abovementioned developing method to be carried out under non-contact conditions, on the other hand, can enjoy some great merits, for example, that is can hold down a fog to a very low degree, and that the allowable range of the concentration of toner in developer may be widened to the order of 5 to 50% by weight (See the left hand side of the curve from the peak thereof in FIG. 1). These merits indicate that this method may be used without replenishing toners provided that there is a suitable image density adjusting means, even if the concentration of toner adjusted in advance to the order of 30 to 50% by weight should be decreased to the order of 10% by weight.

According to the second method relating to this invention, stable images without having any fog may be obtained even if a developer having the concentration of toner of 10 to 90% by weight. In contrast therewith, in the traditional magnetic brush developing method described above, a variation of toner concentration will immediately cause the variation of image density, because the allowable range of the concentration of toner in developer is limited.

For the purpose of preventing the variations of density of image developed, it must be necessary to provide the conventional developing methods each (1) with a toner supply system in which the electrostatic latent image of a standard density image is formed separately from a recorded image on a photoreceptor and the standard density of the electrostatic latent image developed is constantly measured by a photocoupler or the like so as to judge the concentration of toner in developer, for example, the concentration is judged to be insufficient when the standard density of image developed becomes lower than a prescribed density, and fresh toners are constantly replenished to a developer reservoir so that the standard density of image developed may constantly be kept higher than the prescribed density.

Or, it must be necessary to provide the conventional methods each (2) with a control means in which the inductance of developer is constantly measured by an inductance measuring means arranged to the inside of a developer container and toners are replenished to a developer reservoir so that the inductance may be kept at a prescribed level. Concentration of toner in developer is kept constant in a limited range by the control means and the other image forming requirements are also kept constant so that sharp recorded image without having any fog can stably be obtained.

However, in such a method that toner replenishments are controlled so as to keep the concentration of toners in developer constant and the density of image developed, i.e., the density of image recorded, may thus be maintained, the toner replenishing device will be complicated and expensive. It is also required the accuracy when measuring the standard density of image developed in the abovementioned item (1), and when measuring the inductance of a developer in the item (2). In addition, in such a method as the item (1) in which the concentration of toner is obtained indirectly, there is also such a problem as that superfluous toner replenishments may sometimes be carried out by misunderstanding a lowering of the density of toner developed caused by other factors as a lowering of the concentration of toners.

Accordingly, there have so far been demanded strongly, from the viewpoint of image quality, for a developing method capable of obtaining long-life, stable and sharp-cut images recorded by making use of a two-component type developer without necessarily keeping it under an extremely strict control; and for the recording apparatus thereof.

OBJECTS AND SUMMARY OF THE INVENTION

It is the principal object of this invention to provide an improved developing method satisfying the abovementioned demands.

To be more concrete, the above object of this invention is to provide a method of developing an electrostatically charged latent image registered on an electrophotosensitive receptor by applying a bias voltage so as to fly toners from a developer layer laid on a sleeve to the receptor described above, and to provide an electrostatic recording apparatus utilizing the method; and, in particular, to provide a developing method in which a sharp-cut image without having any fog may stably be obtained even in the case that the allowable range of concentration of toner in developer is wider (i.e., higher in the toner concentration) than those in the conventional contact type magnetic-brush developing methods.

This invention is characterized particularly in that a developer having a high concentration of toner is used as described above to vary the image forming requirements (to be described hereafter) in accordance with the variations of the concentration of the toner and thereby the influence of the variations of the toner concentration may be compensated.

Accordingly, the method relating to this invention may still be applicable even in the case of using a developer having a relatively lower concentration of toner such as those being used in the abovementioned contact type methods, and further, more greater merits can be enjoyed in the method relating to this invention when using a developer having a relatively higher concentration of toner at, for example, 10% by weight or higher.

Requirements for forming images are varied according to the substantial decrease of the concentration of toner in developer stored in a developer reservoir. Factors of the requirements to be varied are;

(1) Requirements for electric field between the sleeve and the photoreceptor. (e.g., a bias voltage to be applied to a sleeve, and the kinds of electric currents containing a D.C. or A.C. component.);

(2) Requirements such as a charged potential of a photoreceptor, an amount of exposure, and the like;

(3) Requirements for the conveyance of developer on the sleeve, such as the thickness of the developer on the sleeve, a conveying rate, and the like; or (4) Requirements for the gap between the sleeve and the photoreceptor.

Image forming requirements will be satisfied if at least one or a plurality of the abovegiven requirements are varied according to the decrease in the concentration of toner.

The other objects of this invention will be apparent from the following description of the embodiments of the invention.

DESCRIPTION OF THE PREFERRED EMBODIMENTS

An example of the recording apparatus embodied by the first developing method of the present invention will be explained referring to FIG. 2 as follows.

Figure 2:
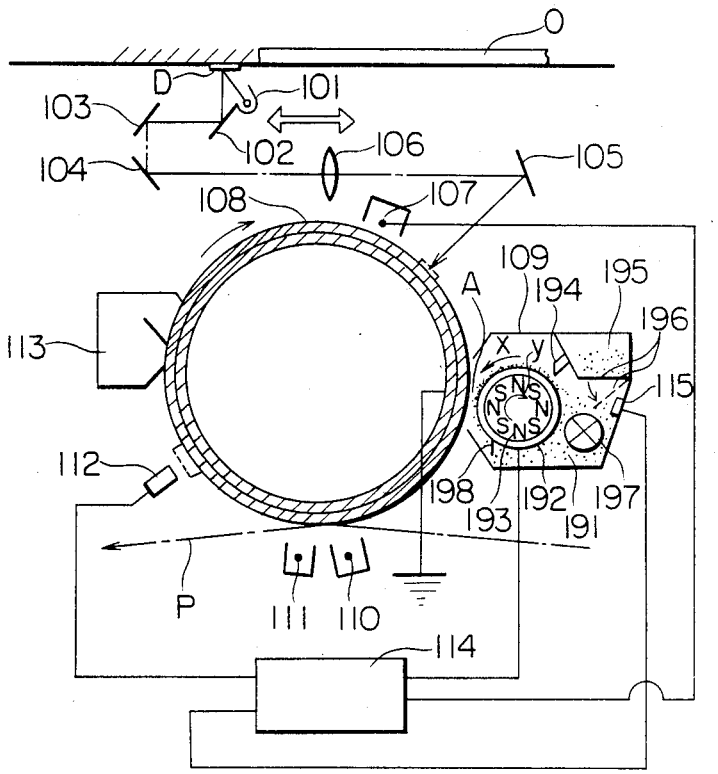
FIG. 2 is a schematic illustration of a construction example of recording apparatuses (an electrophotocopier is shown in this drawing) which can employ a method relating to this invention.

The electrostatic recording apparatus in FIG. 2 shows an electrophotographic copying machine of the type in which the optical system for exposure gives a scanning exposure to the image of the original O to be copied while making reciprocating movements. During the copying operation, exposure lamp 101 and reflection mirror 102 among the optical system for exposure consisting of exposure lamp 101, reflection mirrors 102–105 and lens 106 move to the right at the speed of V. Simultaneously, reflection mirrors 103 and 104 move to the right at the speed of $\frac{1}{2}$V for giving the scanning exposure to the image of original O. Before the scanning exposure for the original O, the optical system for exposure gives a scanning exposure to the image of a standard density piece D. The standard density piece D may be located at an appropriate position which is out of the range occupied by the original and is in the level lower than that of the original.

The light from aforesaid scanning exposure made by the optical system for exposure is led to the surface of the photoreceptor drum 108, namely of the image-forming substance, rotating in the direction of arrow and evenly charged by charging electrode 107. An electrostatic latent image formed thereby on the surface of photoreceptor drum 108 is developed by the magnetic brush type developing unit 109 wherein two-component developer containing carrier particles consisting of particles of magnetic substance and toner powder is employed, to become toner image. The toner images thus formed by developing is transferred onto the recording paper (transfer paper in the type of plain paper) P which is fed, synchronizing with the rotation of photoreceptor drum 108 in accordance with the copying operation, to advance contacting the surface of the photoreceptor drum 108, through the corona discharge performed by energization of transfer electrode 110. In the aforesaid developing, however, the developer is not contacted to the surface of the photoreceptor drum for the development. The recording paper P with toner images transferred thereon is separated from the surface of photoreceptor drum 108 through the discharging action of separation electrode 111 having the same structure as in aforesaid transfer electrode and is fed out of the machine after the toner images thereon have been fixed by the unillustrated but known fixing unit including the roller type one.

In this case, the toner image corresponding to the electrostatic latent image aforesaid standard density piece D passes through the transfer electrode 110 and separation electrode 111 without being transferred onto the recording paper P. Aforesaid standard density of image developed is detected by a detecting means 112 such as the reflection type photosensor consisting of the combination of light emitting element and light receiving element and then is removed, like residual toner after transferring, from the surface of the photoreceptor drum 108 by the cleaning device 113. The detecting means 112 may be provided between the developing unit 109 and transfer electrode 110.

Density information detected by the detecting means 112 is inputted to the main control unit 114 including the processing unit like a microcomputer and a drive control unit controlled by the processing unit for developing bias voltage, charging voltage for photoreceptor or power to be supplied to exposure lamp. Through the inductance measuring means like a coil-sensor provided at the developer reservoir 191 in the developing unit 109, the information of concentration of toner in the developer detected by the toner concentration detector 115 is also inputted to the main control unit 114. However, either the detecting means 112 or the toner concentration detector 115 alone is sufficient.

Aforesaid developing unit 109 has a structure in which the developer in the developer reservoir 191 are magnetically attracted to the surface of the sleeve 192 and ar moved in the same direction as the rotation of the sleeve 192 when the sleeve 192 consisting of non-magnetic and electrically conductive material such as aluminum or stainless steel is rotated in the direction of arrow x and magnet-containing body 193 having plural pairs of N-S poles magnetized normally at flux density of pb 500–1500 gauss is rotated in the direction of arrow y (same direction with the drum at the closest point). As illustrated above, magnets are arranged inside the sleeve and are constituted so that they can rotate relatively to the sleeve. Further, the developer in the layer form whose thickness on the sleeve is controlled by the controlling means such as blade 194, for example, develops the electrostatic latent image prepared on the photoreceptor drum 108 into toner images at the developing area A without touching the surface of the photoreceptor drum 108. In this development, bias voltage is applied on the sleeve 192 from unillustrated power source through main control unit 114, thus the developing electric field is generated between the drum 118 and the sleeve 192 at the developing area A. Incidentally, regarding the relation between the sleeve 192 and the magnet-containing body 193, it may be acceptable that either one of them alone rotates to introduce the developer layer at the developing area A.

In the case of the constitution wherein only the sleeve rotates, it is not necessary to arrange magnetic poles in the magnet-containing body 193 in an S-N-S . . . alternate manner. On this developing unit 109, there is provided toner hopper 195 for supplying toner to developer reservoir 191. Unlike the conventional developing unit, toner is not supplied constantly to the toner hopper 195. Instead, for example, when the satisfactory image density can not be obtained in despite of controlling of developing bias after the toner in the developer is used for a large number of operations of development, the bottom plate 196 is opened in the direction of an arrow, thus large amount of toner are supplied at a time. It may also be acceptable that aforesaid developing unit itself can be replaced with another developing unit wherein the developer having high toner concentration is prepared when the toner concentration in the developer is lowered.

When developing, the developer in the developer reservoir 191 is stirred by the stirring means 197, for example, in the shape of a blade. Toner and carrier are mixed uniformly and during the mixing thereof, toner is triboelectrified to some extent. It is desirable that aforesaid stirring means 197 is energized automatically for a certain period of time through the information of turning on of the power switch of recording apparatus, the information of operation of opening or closing of the bottom plate 196 of toner hopper 195 or the information of replacement of developing unit. In addition to the foregoing, however, it is also acceptable that the switch for stirring operation is manually controlled for operation.

The developer on the sleeve 192, after passing through the section including the developing area A, is removed from the sleeve 192 by the scraper 198. The removed developer is returned to the developer reservoir 191 through under-side thereof and then mixed with the developer in the developer reservoir 191 by the stirring means 197 to be attracted onto the sleeve again for its circulation.

Through the information from the detecting means 112 and/or the information from the toner concentration detector 115, the main control unit 114 controls 1 or 2 or more of bias voltage for development to be applied on the sleeve 192, discharging voltage to be applied on the charging electrode 107 or the speeds of revolution of the magnet-containing body 193 and the sleeve 192. Owing to the foregoing, it functions that unfogged clear image can be obtained for a long time until the supply of toner or replacement of developing unit 109 despite the substantial change of toner concentration in the developer contained in the developer reservoir 191. These circumstances will be explained below referring to FIG. 3–FIG. 6.

Figure 3:
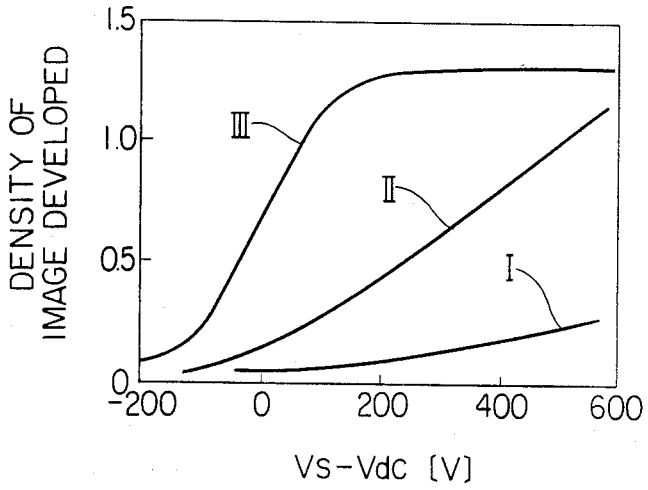
FIGS. 3 and 4 are the characteristic lines indicating the tripartite relations among electrostatic potentials of image, bias voltage to be applied to a sleeve for development, and density of image developed for recording.
Figure 4:
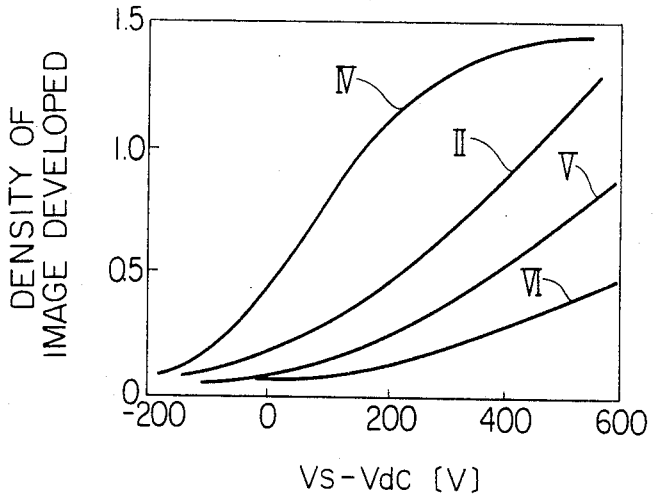

FIG. 3 and FIG. 4 show the density of image developed curve in which the amplitude of the alternate current component of bias voltage to be applied on the sleeve when developing under constant temperature and humidity, is changed and the density of image developed curve in which the frequency of alternate current component is changed, respectively. These density of image developed curves were obtained with the constant toner concentration in the developer under the following conditions.

In the constitution of FIG. 2, the photoreceptor drum 108 having Se photoreceptor layer on its surface and a diameter of 120 mm rotates to clockwise-direction at a surface velocity of 120 mm/sec. It is electrically charged by the charging electrode 107 at +600 V and a latent image of electrostatic charge having the surface potential of Vs is formed on its charged surface by means of an exposure unit. The developing unit 109 includes the sleeve 192 having a diameter of 30 mm and surface clearance between the sleeve and the photoreceptor drum 108 is set in about 0.7 mm. When developing, the sleeve 192 rotates counterclockwise at a surface velocity of 120 mm/sec. The magnet-containing body 193, on the other hand, rotates clockwise at the speed of 600 rpm. The developer consisting of non-magnetic toner and magnetic carrier both in the developer reservoir 191 is formed on the sleeve 192 as a developer layer with a thickness of 0.5 mm by the control blade 194. Through the mixing action made by the stirring means, aforesaid toner is charged negatively. When developing, the bias voltage consisting of superimposed direct current component Vdc and alternate current component is applied on the sleeve 192. The alternate current component causes the toner in the developer on the sleeve to fly up and thus functions so that electrostatic latent image on the photoreceptor is developed, while the direct current component functions in principle to prevent fog.

Abscissas in FIG. 3 and FIG. 4 represent the difference between the surface potential Vs and the direct current component Vdc of bias voltage, while the ordinates represent recorded image density, namely the density of image developed. I, II and III in FIG. 3 represent density of image developed curves for 1 kHz of frequency of alternate current component for causing toner to fly in the bias voltage and for the amplitude, that is the width from the central value to the peak, varying as 0 kV, 1 kV and 2 kV respectively. IV, V and VI in FIG. 4 represent density of image developed curves for 1 kV of amplitude of aforesaid alternate current component and for the frequency varying as 700 Hz, 2 kHz and 4kHz respectively.

As is obvious from FIG. 3, when the amplitude of alternate current component of bias voltage is made larger or smaller, the density of image developed changes accordingly to higher or lower level. Therefore, it is possible to compensate the change in the density of image developed caused by the change in the toner concentration in the developer, utilizing the aforementioned phenomena. Further, as obvious from FIG. 4, the density of image developed changes to higher or lower level even with the change of frequency of bias voltage to smaller or larger value, which can also compensate the influence caused by the change of toner concentration in the developer. When initial purpose is attained by changing the bias voltages in this manner, it is possible to determine the level to be set at the appropriate number of steps by checking experimentally the relation between a decrease of toner concentration and corresponding recorded image density. Further, as the abscissas of FIG. 3 and FIG. 4 show, it is possible to compensate, to a certain degree, the influence caused by the change in toner concentration in the developer by changing the direct current component Vdc of the bias voltage or by changing the surface potential Vs, that is the voltage charged by the charging electrode 107 or the intensity of image-wise exposure effected by the exposure lamp 101. The density of image developed curves in FIG. 3 and FIG. 4 were obtained from the photoreceptor drum 108 whose photoreceptor layer is composed of Se photoreceptor and the density of image developer curves mostly the same as above-mentioned curves can be obtained even from the other photoreceptor layer which is composed of OPC photoreceptor that means organic photoconductor and of other photoreceptor.

Figure 1:
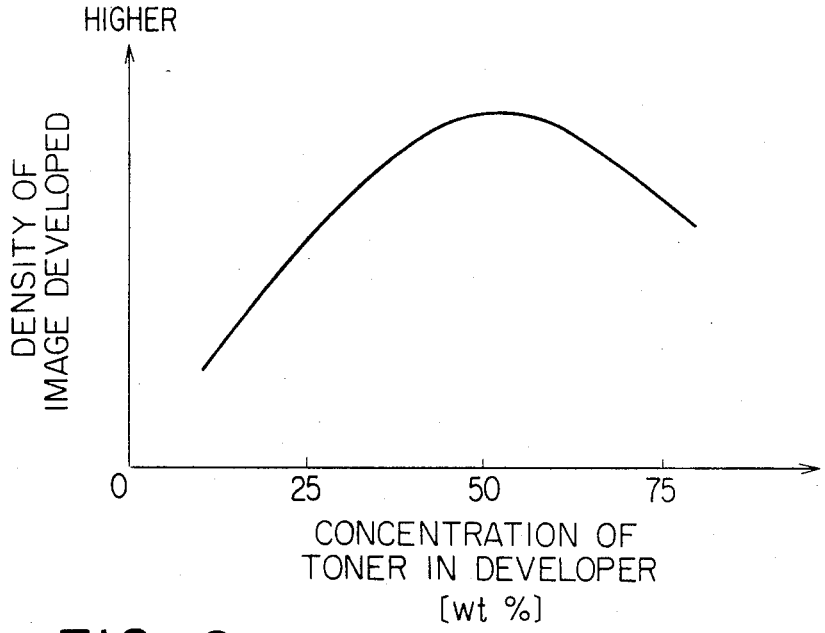
FIG. 1 is a characteristic line indicating the relation between the concentration of toner in a two-component type developer and the density of an image developed for recording, in the case that, according to this invention, toners are flown from the surface of a sleeve to develop a latent image. (Hereinafter, this method will sometimes be called a jumping type developing method.)
Figure 5:
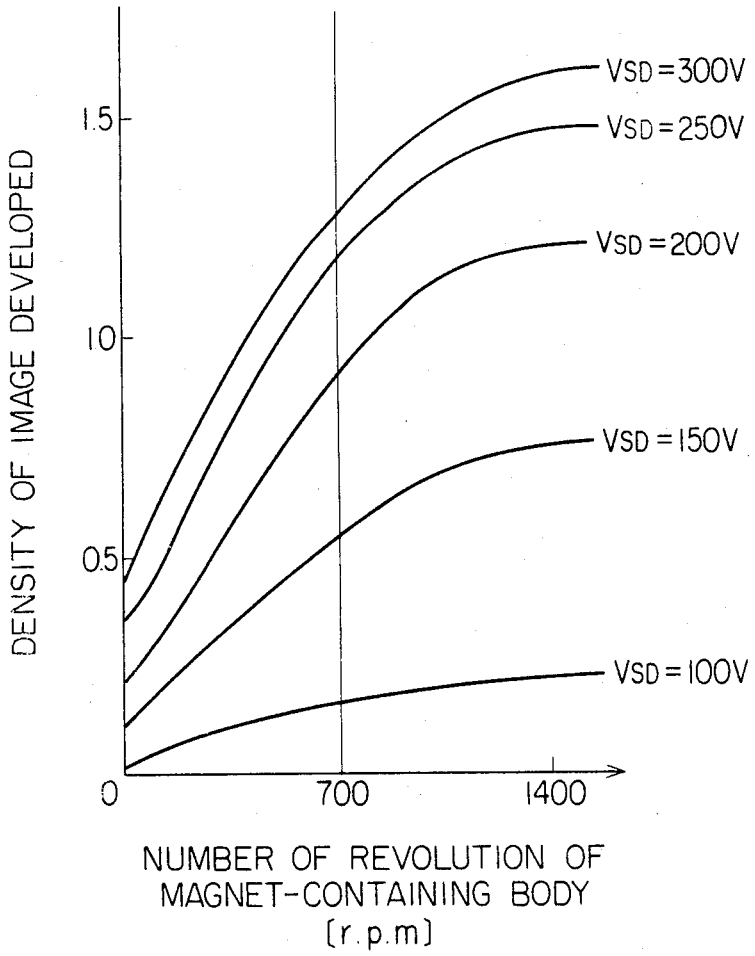
FIGS. 5 and 6 are the characteristic lines indicating the relation between a developer conveying speed regulated by the rotations of the sleeve and a magnet-containing body and the density of image developed for recording.
Figure 6:
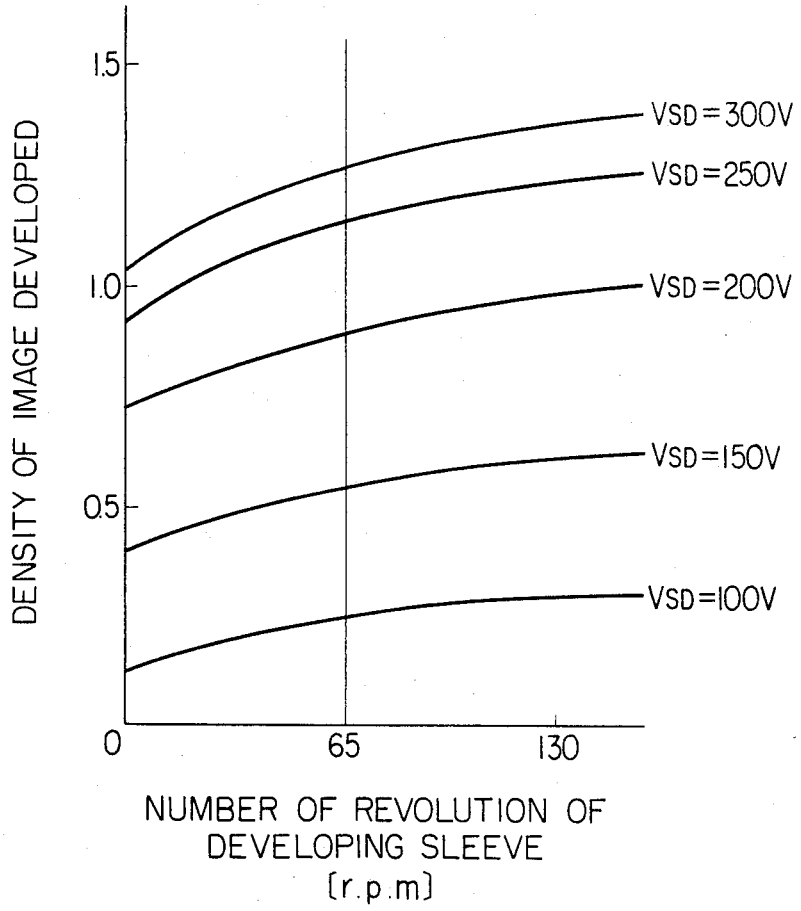

FIG. 5 and FIG. 6 show the density of image developed curves obtained when the speed of revolution of magnet-containing body 193 was changed during the development in the apparatus having the structure identical to that in FIG. 1 and the density of image developed curves obtained when the speed of revolution of the sleeve 192 was changed, respectively. Both curves were obtained with the initial toner concentration which was kept constant for both cases.

The characteristic curves in FIG. 5 and FIG. 6 were obtained with the photoreceptor drum having an OPC photoreceptor layer and a drum diameter of 120 mm rotated in the direction of an arrow at the surface speed of 120 mm/sec and the same results may be obtained even from the photoreceptor layer composed of Se photoreceptor and others.

In drawings, VSD shows the absolute value of the difference between the negative electrostatic latent image voltage with its absolute value of 150 V or more formed on the photoreceptor drum 108 with variation of document density and the direct current component of −150 V of the bias voltage applied on the sleeve 192. In the foregoing, the surface clearance between the sleeve 192 and the photoreceptor drum 108 was controlled to be 0.75 mm and the thickness of developer on the sleeve 192 was controlled to be 0.35 mm by the control blade 194. Further, in the case of FIG. 5, the speed of revolution of the sleeve 192 in the direction of an arrow was set constant at 65 rpm while the speed of revolution in arrow direction of the magnet-containing body 193 having plural magnetic N-S poles magnetized at magnetic flux density of 900 gauss and arranged at regular intervals along the circumference of the sleeve, was changed as shown on abscissa and in the case of FIG. 6, the speed of revolution of magnet-containing body 193 in the direction of an arrow was kept constant at 700 rpm while the speed of revolution in an arrow direction of the sleeve 192 was changed as shown on abscissa. Further as a developer, two-component developer consisting of insulating and magnetic carrier with specific resistance of about $1\times10^{14}\Omega$cm wherein magnetic substance powder is dispersively contained in the resin having the weight average particle size of about 30 μm and of insulating non-magnetic toner having average particle size of about 13 μm and being charged in positive, was used and when developing, the bias voltage wherein the direct current voltage of −150 V and alternate current voltage of 1500 V, 2 kHz are superimposed was applied on the sleeve 192. Incidentally, even when the speed of revolution of the sleeve 192 is changed with the magnet-containing body 193 fixed, the dependency of the density of image developed on the speed of revolution of the sleeve 192 shows the same tendency as in FIG. 6.

As is obvious from FIG. 5 and FIG. 6, it is possible to compensate the influence of the change of the toner concentration in the developer even by changing the speed of revolution of the magnet-containing body 193 or of the sleeve 192.

According to the information from the density of image developed detecting means 112 and/or the toner concentration detector 115, the main control unit 114 changes 1 or 2 and over of the bias voltage, discharging voltage of charging electrode 107 and the velocity of revolution of magnet-containing body 193 and sleeve 192, so that the influence of the change in toner concentration in the developer (the change of the density of image developed as seen in FIG. 1) may be compensated as described above. Therefore, the constant density of image developed which is constant density on recorded image against the constant density of document can be obtained during the period until the time of toner supply and replacement of developing unit despite the change of toner concentration in the developer as described above.

In the recording apparatus shows in FIG. 2, if the information detected from the detecting means 112 show the drop lower than a certain level of the standard density of image developed, it is possible to make the main control unit 114 to control, warn and indicate that toner supply and/or replacement of developing unit should be done, despite the change of image-forming conditions made by the main control unit 114 as stated above. If, according to the warning, toner supply or replacement of developing unit is done as stated before, troublesome device for supplying constantly into the developer reservoir the toner equivalent to the amount consumed, is not necessary and it is possible to obtain the clear image without fog which is constantly stable for the long period. However, the present invention may be the one wherein an operator judges the timing of toner supply or of replacement of developing unit by observing the recorded image, without being limited to the example in FIG. 2.

Figure 7:
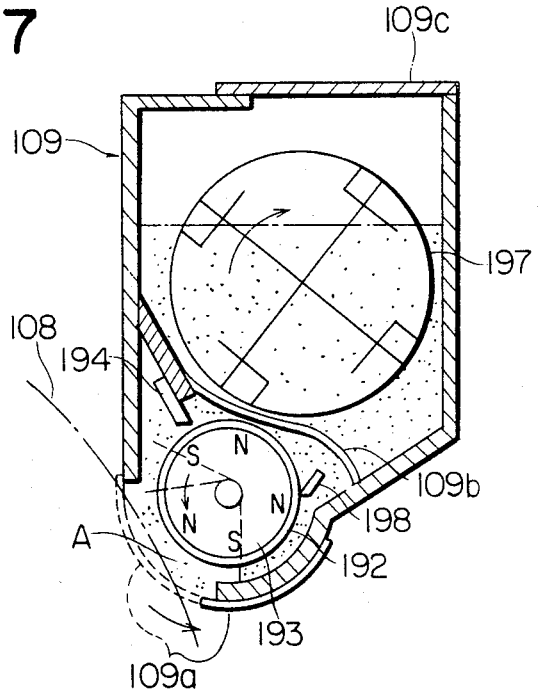
FIGS. 7 and 8 are a schematic illustrations of the construction examples of developing apparatuses for employing a developing method relating to this invention.
Figure 8:
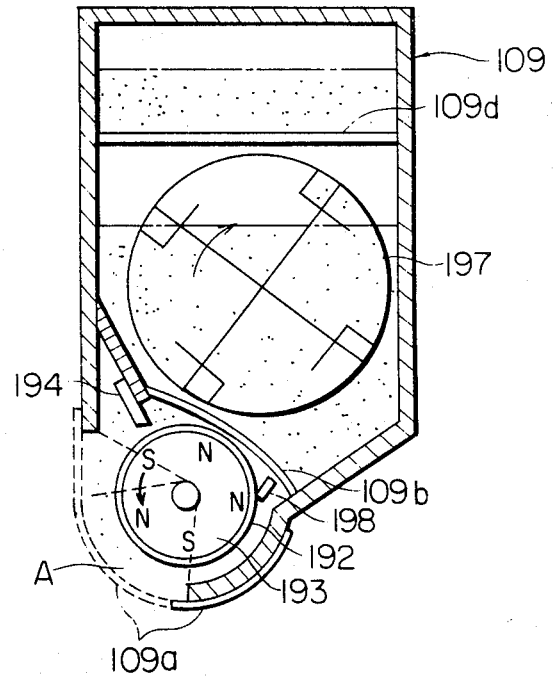

FIG. 7 and FIG. 8 show the examples of replaceable developing unit. In the figures, marks or symbols which are the same as those in aforesaid FIG. 2 represent the members having the same function. The developing unit 109 in FIG. 7 and FIG. 8 has a cover member 109*a* which is deviated one-sidedly by the spring or the like, when the developing unit is not mounted on the recording apparatus, so that it covers (like dotted lines) the surface of the sleeve 192 corresponding to the developing area A. When the developing unit is mounted on the recording apparatus, aforesaid cover member 109*a* is brought to the position shown with solid lines, thus developable condition is created. Namely, the aforesaid cover member serves to prevent the developer from falling out of the portion of developing area A when the developing unit is mounted on or dismounted from the recording apparatus or it is carried. Further, with the detachable partition member 109*b* provided between the agitating means 197 and the sleeve 192 positioned underneath, it is possible to further prevent the developer or toner held at the side of agitating means 197 from falling out before being attached to the apparatus. The developing unit 109 shown in FIG. 7 is controlled so that toner can be supplied after the develoer-intake-cover 109*c* is opened when the toner supply timing presents itself as stated before. It is also naturally practicable that toner supply is made on the developing unit 109 dismounted from the recording apparatus. On the developing unit 109 in FIG. 8, the detachable partition member 109*d* for toner reservation is provided at the side opposite to the partition member 109*b* around the agitating means 197 and thus the toner can be supplied into the developer reservoir with this partition member 109*d* which is removed when the toner supply timing presents itself. This toner supply may also be made either with the developing unit 109 mounted on the recording apparatus or with the developing unit 109 dismounted from the recording apparatus.

Aforesaid developing units 109 in FIG. 7 and FIG. 8 are also used as the developing method of the present invention with the control such as developing bias and others performed in the same way as what explained referring to FIG. 2.

In the first developing method of the present invention described above, it is desirable to keep the clearance between the surface of the photoreceptor drum 108 and the surface of the sleeve of the developing unit in the range from several tens of $\mu$m's to 2000 $\mu$m and to keep the thickness of the developer controlled by the control blade 194 on the sleeve to be less than said clearance. If the clearance at the developing area is too small, the thickness of the developer on the sleeve must also be extremely small, which disable to obtain the uniform thickness of developer layer. In this case, it is difficult to supply toner into the developing area A constantly. Further, the problem that the discharge easily takes place between the sleeve 192 and the photoreceptor drum 108, is generated. On the contrary, when the clearance at the developer area A is too big, it is difficult to control the flying of toner caused by vibrating electrical field. In the developing method relating to the present invention, it is desirable to use, as the developer, two-component developer consisting of insulating and magnetic carrier particles having high resistance such as electrical resistivity of more than $10^8\Omega$cm, preferably more than $10^{13}\Omega$cm and toner particles, because it is possible to control effectively the flying of toner by applying sufficient bias voltage on the sleeve 192. As the carrier particles like the ones described above, carrier particles wherein resin coat is formed on the surface of magnetic substance particle, or the carrier particles consisting of resin particles containing dispersively magnetic substance particles is used.

Aforesaid electrical resistivity represents the value obtained as a reading of a current value when insulating particles are put in the container having a cross-sectional area of 0.5 $cm^2$ and adjusted in volume to be about 1 mm in thickness and after tapping, a load of 1 $kg/cm^2$ is applied on the rammed particles and the current value is read when its voltage is applied between the electrode which serves concurrently as the aforesaid load against the particles and the bottom electrode so that an electric field of 1000 V/cm may be produced between aforesaid two electrode.

Further, it is preferable that the average particle size of toner is in the range from 1 $\mu$m to 20 $\mu$m, especially in the range from 1 $\mu$m to 10 $\mu$m and the average particle size of carrier particles is in the range from 5 $\mu$m to 50 $\mu$m for fine and delicate images to be reproduced faithfully. The average particle size of these particles is a weight average particle size and is measured by Coulter Counter (mfd. by Coulter Electronics Co.) or by Omnicon Alpha (mfd. by Bausch & Lomb Co.). If the average particle size of the toner particles is too small, the amount of triboelectrification caused by friction for one particle of toner is small and relatively, the van der Waals force is large, thereby flocculation thereof easily takes place and separation and flying thereof hardly take place. On the contrary, if the average particle size is too big, the charged amount per weight is reduced and thereby it is difficult to control the flying thereof and the resolving power falls. While, if the average particle size of carrier particles is too small, the force of attraction by the magnetic force of magnet-containing body 193 is small and contrary to this, electrical Coulomb force and van der Waals force are large and thereby carrier particles, together with toner particles, are easily moved to the surface of the photoreceptor drum 108 and to the edge portion of the latent image. On the contrary, if the average particle size is too big, the width of torelance of toner concentration is reduced and developer layer formed on the sleeve 192 becomes coarse and the uniform thin layer of developer is hard to be formed. Further, the attaching condition of toner particles in the developer layer loses its uniformity and breakdown and discharging of the voltage to be applied on the sleeve 192 tend to happen, thus, it is hard to control the transfer and flying of toner particles.

Next, similar to the above description, the second developing method relating to this invention will be described, in which a sharp and un-fogged recording image can stably be obtained even under the conditions of using a developer having the concentration of toner stored inside a developer reservoir which is higher than the concentration within the allowable range.

Figure 9:
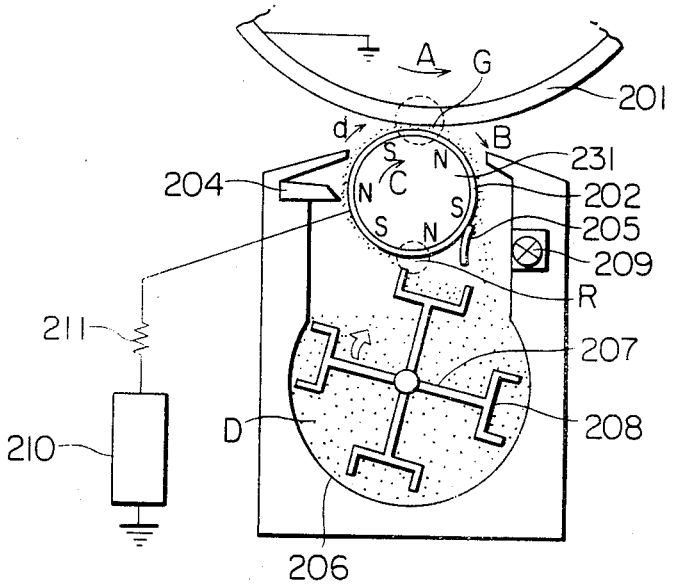
FIGS. 9, 10, and 11 each are the schematic illustrations of a part of recording apparatus and, in particular, a developing device, for employing the other developing method relating to this invention.
Figure 10:
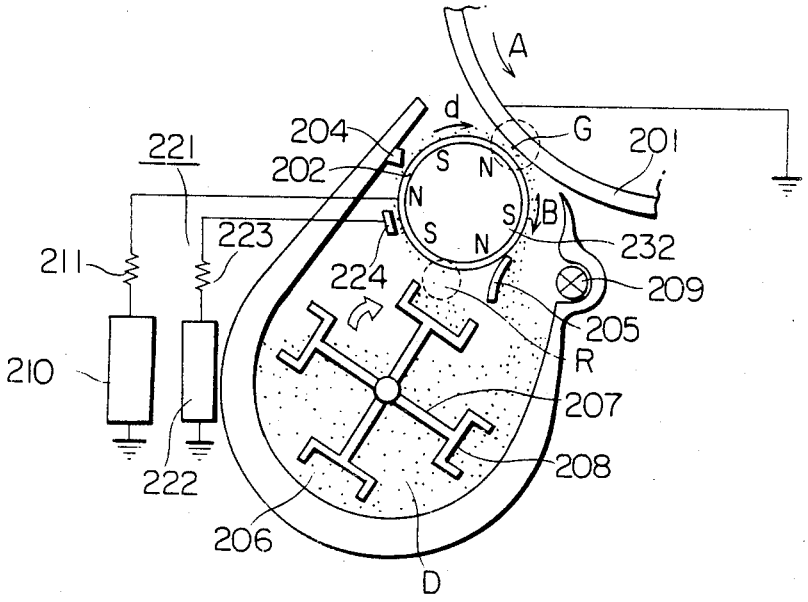
Figure 11:
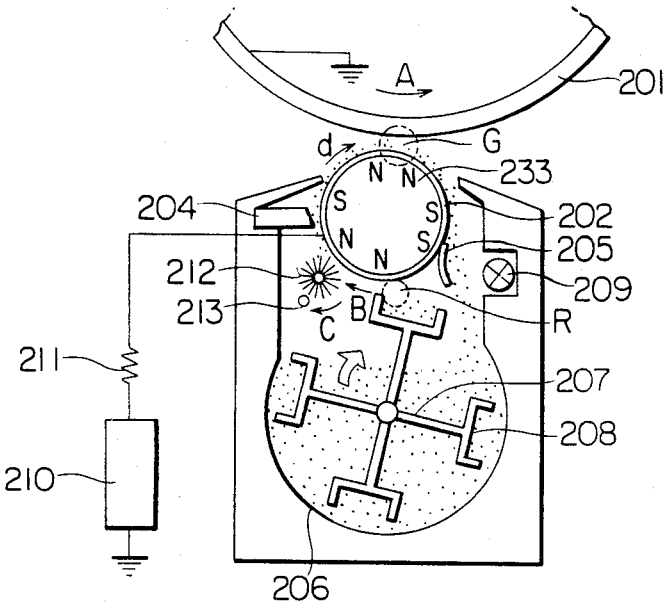

FIGS. 9 through 11 illustrate respectively the cross-sectional views of the substantial portions of electrostatic recording apparatuses capable of using the second method relating to this invention. Apart from the positional correlation between the portions, the other portions not shown in the drawings may be considered in about the same way as in the case of FIG. 2.

In the drawings, reference numeral 201 is a photoreceptor made of, for example, Se or the like to which an electrostatic latent image is formed on the surface thereof by means of a charging and exposure device (not shown). On the rear side of the photoreceptor, there is an electroconductive member grounded with the back thereof or through a suitable power source; 202 is a sleeve comprising such a non-magnetic material as aluminium or the like; and 231, 232 or 233 is magnet-containing body having a plurality of N.S. magnetic poles in the peripheral direction and being arranged inside sleeve 202. And, sleeve 202 and magnet-containing body 231, 232 or 233 are so arranged as relatively be rotated. In FIGS. 9 through 12, this sleeve 202 rotates in the direction of the arrow B, that is, it rotates clockwise. The N.S. magnetic poles of the magnet-containing body 231, 232 or 233 are magnetized normally to the magnetic flux density of 500 to 1500 Gs. By this magnetic force, the ears of developer D, i.e., a magnetic brush, are formed on sleeve 202. Magnetic brush herein referred to is not such a conventional one as that develops images by coming into contact with a photoreceptor. 204 is a blade comprising a magnetic or non-magnetic body for regulating the height or quantity of magnetic brush; and 205 is a cleaning blade which removes a magnetic brush passing through developing area G from the surface of sleeve 202. Developer D is supplied to the developer carrier surface (hereinfter simply called the surface) of sleeve 202 from area R whereto the developer is supplied by backet 208 mounted to agitating means 207 for agitating developer D in developer reservoir 206 i.e., a developer supplying section, and the developer D is then conveyed to developing area G. Toner particles of developer D in developer reservoir 206 are consumed when a development is carried out for a long time. To replenish toner particles T which are not shown, a toner hopper is provided and a screw-shaped toner supplying roller 209 is also provided so as to feed toner particles T from the toner hopper to toner reservoir 206.

Concentration of toner in developer is from 10 to 90% by weight that is overall higher than the conventional concentration percentage from 2 to 10% by weight. Needless to say, it is possible to use any developer having such a toner concentration as is applicable in a contact developing method. In other words, it is possible to satisfactorily use a developer having a toner concentration range applicable to the first method of this invention. The toner concentration range will depend upon the difference between the constitution of the developing methods. Toner particles are not so precisely replenished from the aforementioned toner supplying roller 209 as is replenished in a conventional manner but is replenished a little bit more so that the toner concentration can be higher than the prescribed degree, i.e., an excessive amount of toner can be replenished.

The term, "Excessive toner" means such an amount of toner that is larger than the suitable amount thereof for performing an excellent development under prescribed development conditions. For example, in the case that a certain amount of toners is capable of single-coating the surfaces of all the carrier particles, the amount thereof more than that is called an excessive toner.

210 is a bias power source for applying a bias voltage containing an A.C. component or an A.C. component and a D.C. component in combination to sleeve 202, through protective resistor 211.

Principal difference between the developing device illustrated in FIG. 9 and that in FIG. 10 is as follows;

In FIG. 9, sleeve 202 rotates in the direction of arrow B, and magnetic containing body 231 rotates in the same direction, that is, in the direction of arrow C, and the magnetic flux density of N.S. poles are almost the same with each other; and, by contrast therewith, in the developing device shown in FIG. 10, sleeve 202 rotates in the direction of arrow B, however, magnet-containing body 232 is fixed, and the magnetic flux density of the N.S. poles are not the same with each other but the magnetic flux density of N-poles opposite to image carrier 201 are greater than those of the other poles.

In the developing device shown in FIG. 11, sleeve 202 rotates in the direction of arrow B, however, magnet-containing body 233 is fixed, and N-poles are juxtaposed each other so as to face to the image carrier. It is also allowed to arrange a single-pole or to juxtapose N-poles and S-poles, so as to face to the image carrier.

Now, in the developing devices as shown in FIGS. 9, 10, 11, respectively, the concentration of toners in a toner reservoir is higher than the prescribed concentration, therefore, many toners are not satisfactorily triboelectrified with carriers and many coherent matters of toner particles are produced. These unsatisfactory triboelectrified toners and toner coherent matters are the needless toners and it is not needed to replenish them to a sleeve. Consequently, toners (in particles) triboelectrified with and adhered to carrier (in particles) would be necessary enough for a development purpose, and therefore, if unnecessary (or extra) toners (in particles) are spilled to remove in the process where the toners are supplied from a developer supplying section to a sleeve, or in the process of conveying a developer layer over the sleeve, then a toner layer having a prescribed toner concentration may be obtained.

Accordingly, in this invention, as illustrated in FIGS. 9, 10, 11, for example, each of the construction is so designed as to set downward at least one portion of the surface of the sleeve carrying developers thereon in the course of conveying the developers to a developing area, so that unnecessary toners may be separated from a developer layer by their own gravity.

Figure 12:
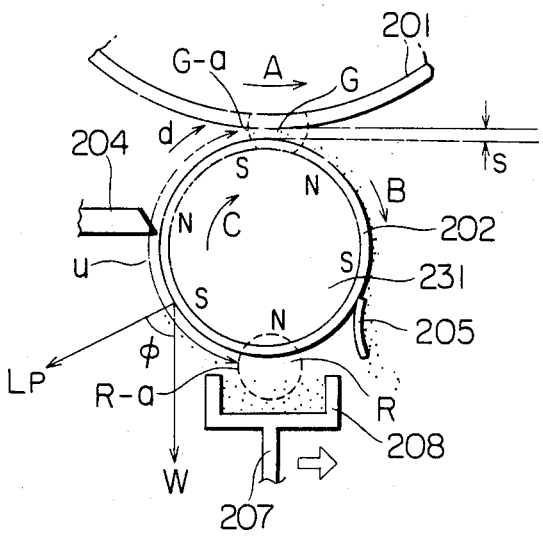
FIG. 12 is an enlarged view of the substantial portion of the periphery of the sleeve of the developing apparatus shown in FIG. 9.

To be more concrete, as shown in FIG. 12 which is an enlarged view of the substantial part of the developing roller and the periphery thereof illustrated in FIG. 9, at each point of the surface of the sleeve (hereinafter called the conveying surface U) which conveys developers from the trailing and R-a of the area to be supplied R (bounded by a broken line) on the sleeve to the leading and G-a of developing area G where toner (in particles) reaches the surface of an electrostatic latent image so as to be developed, at least one angle $\phi$ between normal line Lp and the direction of gravity W is made to be $0 \leqq |\phi| < 90°$, and besides, unnecessary toners in the course of conveyance are relatively weak in adherence power (i.e., coulomb friction force) to carriers, therefore, the unnecessary toners are dropped out of the points by the gravity and removed, so that a prescribed concentration may be regulated.

To assure the dropping of unnecessary toners in a large amount, it is desirous to enlarge the surface of the sleeve having the normal line having the formula of $0 \leqq |\phi| < 90°$. In the developing devices shown in FIGS. 9 and 11, the toner conveying surface U having the formula of $0 \leqq |\phi| < 90°$ is somewhat larger than that shown in FIG. 10 because developer is supplied under the sleeve, so that a somewhat lager amount of unnecessary toner will be dropped, provided that the conditions of the developer conveyor and the periphery thereof shown in FIGS. 10 and 11 should be the same as those shown in FIG. 9.

When the surface of a developer conveyor comprises a cylindrical sleeve, the conveying surface having the normal line having the formula of $0 \leqq |\phi| < 90°$ is preferably not smaller than a quarter of the whole surface of the sleeve, more preferably not smaller than one third thereof, and still more preferably about one half thereof. Even when a developer conveyor is not cylindrical but, for example, a belt in the oval form, the larger a toner conveying surface having a normal line of $0 \leqq |\phi| < 90°$ is, the better.

To drop unnecessary toner out of the conveyor surface as much as possible, the larger the conveyor surface having a normal line of $0 \leqq |\phi| < 90°$ is, the better, as described above, however, in the case of utilizing this developing device or this method in electrophotography, there may be some instances where it is allowable to arrange such developing device aslant even if the conveyor surface having a normal line of $0 \leqq |\phi| < 90°$ is somewhat smaller as illustrated in FIG. 10, because of the correlative arrangements of the other members and the like.

To promote the dropping of unnecessary toners, it is also allowable to vary a magnetic field to be generated on a developer layer in the conveying process and to shake the developer. This shaking is generated by the rotations of the magnet-containing body and the sleeve of a developer conveyor in the embodied example shown in FIG. 9, or, in the developing devices shown in FIGS. 10, 11, such shaking is generated in the manner that the sleeve is rotated around the outer circumference of fixed magnet-containing body of the developer conveyor, and thereof the magnetic flux on the surface of the sleeve is varied.

In the example illustrated in FIG. 11, in addition to the fixed homopolar magnet-containing body, there added with a rotating brush 212 and a dusting far 213 which removes toners being adhered to the brush, to the developer conveying surface of the sleeve 202, so that they can rub against the developer layer to further remove unnecessary toners.

It is desirous that the brush is rotated in the direction of arrow e so as to be opposite to the direction of arrow d that is the direction of conveying developers. Further, in the case that such brush operates effectively, it is a matter of indifference whether the conveyor surface does not satisfy the formula of $0 \leqq |\phi| < 90°$.

It is also allowable to readily drop unnecessary toners in the manner that an electric vibration field is applied to a conveying surface to vibrate developer by means of a bias device comprising such a voltage generating source 222 as that shown in FIG. 10, a protective resistor 223 and an electrode 224 arranged so as to oppose to a developer layer in the course of conveyance, in place of or in addition to brush 212. It would be better to use electrode 224 having the length equivalent to or little longer than the length of the sleeve and having the shape of a column, a square pillar, a flat board, or a board curved along the surface of the sleeve.

Now, the developer from which unnecessary toner was removed as described above is regulated by regulating blade 204 to make a developer layer constant in thickness. Though the unnecessary toner was removed in the course of conveyance, the toner concentration in a developing area is relatively higher than the very strictly regulated toner concentration of a conventional two-component type developer, therefore, the toners in the developing area contain a lot of unsatisfactorily charged toners. Such toners are apt to adhere also to non-image areas on the surface of the image conveyor by van der Waals' force or the like, so that fog is liable to cause. To cope therewith, it is required that the described regulated thickness of the developer layer is to be less than space S between the surface of the image carrier and the surface of the sleeve.

When a development is made on the upper side of the sleeve as shown in FIGS. 9, 10, and 11, unnecessary toners being adhered to non-image areas are dropped because a strong gravity is applied to the unnecessary toners, so that images can be obtained without having any fog. In addition, as illustrated in FIGS. 9 and 11, it is also preferable that the image carrier surface and/or the sleeve surface in a developing area, and preferably in the center thereof, is to be vertical to the direction of the gravity, because a greater amount of the gravity is applied to the unnecessary toners.

Now, referring to the embodiments of developing methods and apparatuses shown in FIGS. 9, 10 and 11, sleeve 202 of the developing device is so arranged as to keep the space S in the range of several tens $\mu$m to 2000 $\mu$m to image carrier 201. Developer layer formed on the surface of sleeve 202 forms a magnetic brush. Such brush moves with shaking on the sleeve or moves with shaking according to the rotation of magnet-containing body 203 because the magnetic flux density of the sleeve surface is varied by its own rotation, so that a development may be performed when the magnetic brush reaches the developing area. To avoid an occurrence of any fog at this moment, sleeve 202 is applied with a D.C. bias voltage by bias voltage generating source 210 so as not to adhere any toner particle to the non-image areas, i.e., the background areas, of an electrostatic latent image on image carrier 201.

To be more preferable, it is advisable that the bias voltage is to be made of a vibration voltage comprising the abovementioned D.C. voltage including 0 V and an A.C. voltage which is superposed on the D.C. voltage to vibrate the magnetic brush, and that the vibration electric field thus obtained is to be applied to the space. The waveform of the vibration electric field may suitably be selected from a square wave, a sine wave, a pulse wave and the like.

To obtain an image without having any fog, as described before, the thickness of a developer layer regulated by a regulating blade is to be thinner than the space S between the surface of an image carrier and the surface of a sleeve, and in this case, only the charged toners are substantially moved to the surface registered with a latent image, and it is, therefore, not necessary to agitate the toners so severely by making use of agitator 207.

In particular, when applying a vibration voltage to sleeve 202 from a bias voltage generating source, a sharp and clear image without having any fog may be obtained, because the thickness of the abovementioned developer layer is thinner than space S. One of the reasons why such an excellent image may be obtained is as follows; In this invention, the toner concentration in a developer is high and the developer contains many of unnecessary toners which are unsatisfactorily charged, however, when treating as described above, only the charged toners are moved mainly to the surface registered thereon with an electrostatic latent image, and among the toners the toner particles moved to non-image areas are returned again onto the sleeve 202 and, on the other hand, the unnecessary toners remaining unsatisfactorily charged can hardly reach the surface registered thereon with the electrostatic latent image and such toners are also disturbed to move by the gravity. It is also desired that this vibration electric field could be an alternate electric field (whose direction is alternated).

For a D.C. voltage component, a 50 to 600 V is normally used which is higher than the potentials of non-image areas, and, for an A.C. voltage component, a frequency of 100 Hz to 10 KHz and preferably 1 to 5 KHz is used. The voltage value of an A.C. voltage component is related to a frequency, but the higher the voltage value is, the more a magnetic brush is vibrated, and it is heighten such an effect as much that sharp and clear images may be obtained. On the contrary, a fog is apt to cause and a dielectric breakdown such as a thunderbolt phenomenon is liable to occur. To avoid these troubles, the virtual value of the voltage would preferably be 200 to 4000 V. When the frequency is increased, the movement of developer cannot follow the electric field. Accordingly, it tends to lower the density of image developed and the sharpness of image developed so as to worsen the quality of images.

Figure 15:
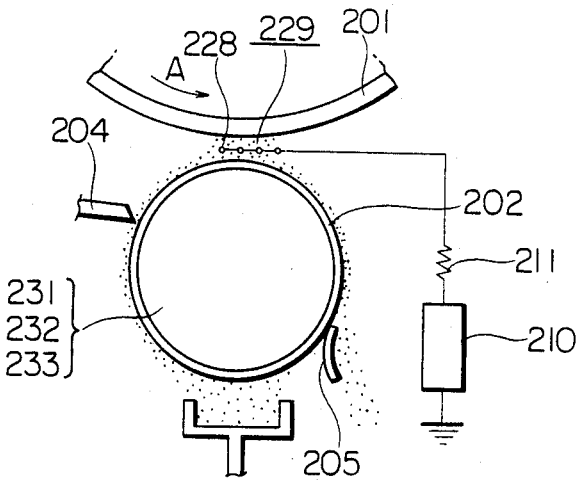
FIG. 15 is an enlarged view illustrating a substantial portion of the other embodied example of apparatuses for employing the developing methods relating to this invention.

As described above, the embodiments of this invention are characterized in that developers on a sleeve is moved to the surface registered thereon with an electrostatic latent image by a vibration electric field, however, the embodiments of this invention are not limited to such an application of a vibration electric field to a sleeve as shown in the concrete examples. For example, as illustrated in FIG. 15, it is also allowed to arrange a member 229 comprising some of stretched electrode wires 228 between an image carrier and a sleeve and a vibration voltage is then applied to the member 229, while a D.C. voltage or a differenct vibration voltage is applied to the sleeve.

It is also possible to apply the developing methods embodied by this invention as well as the developing devices thereof to a reversal type developing methods and the device thereof. In this case, however, the D.C. component of a voltage to be applied to a sleeve is to be determined as is approximate to the voltage of non-image areas of an electrostatic latent image.

Next, the second developing method of this invention will be described in drawing the concrete examples thereof into comparison with the comparative examples. In the description, an average particle size in diameter expressed in the examples means an average particle size by weight unless otherwise specified.

EXAMPLE 1-a

Magnetic powder (manufactured by Toda Industry Co., Japan) comprising magnetite having the average particle size of 0.2 μm was dispersed at 50% by weight in styrene. acryl resin (Higher-up 110, manufactured by Sanyo Chemical Industry Co., Japan) so as to prepare the particles whose magnetization ratio was 30 emu/g, resistivity was $10^{14}\Omega$cm and average particle size was 20 μm. Thus prepared particles were used as the carrier particles.

Non-magnetic particles were prepared so as to comprise 100 parts by weight of styrene acryl resin (Higher-up 110, manufactured by Sanyo Chemical Industry Co., Japan), 10 parts by weight of carbon black (MA-100, Manufactured by Mitsubishi Chemical Industries, ltd., Japan) and 5 parts by weight of nigrosine and to have the average particle size of 10 μm. Thus prepared non-magnetic particles were used as the toner particles. A development was carried out with thus prepared carrier particles and toner particles by making use of the device illustrated in FIG. 9, under the conditions that the proportion of the toner particles of developer D in developer reservoir 206 was 40% by weight to the carrier particles, i.e. the toner concentration was 28.6%.

In this case, image carrier was a CdS photoreceptor, and the peripheral velocity thereof was 180 mm/sec; a maximum potential of an electrostatic image formed on image carrier 201 was −500 V, and the potentail of non-image areas was −100 V; the outside diameter of sleeve 202 was 30 mm, and the number of revolutions of the sleeve was 100 rpm; the magnetic flux density of N,S poles of magnet-containing body 231 was 900 gauss, and the number of revolutions of the magnet-containing body was 500 rpm; the thickness of developer layer laid on the sleeve was 0.6 mm, i.e., 600 μm, and the space between sleeve 202 and image carrier 201 was 0.7 mm, i.e., 700 μm; and, the bias voltage applied to sleeve 202 was −150 V in terms of a D.C. voltage component, and 1.5 kHz, 800 V in terms of an A.C. voltage component.

After developing under the described conditions, the image developed was transferred to a sheet of plain paper and was then fixed through a heat-roller type fixing device at the surface temperature of 140° C. The image resultantly obtained was high in density, excellent in sharpness and had neither edge-effect nor fog at all. After then, 50,000 copies were successively obtained in which every stable and invariable image was obtained from the beggining to the end.

EXAMPLE 1-b

Copies were obtained under the same conditions as those in Example 1-a, except that a D.C. voltage component only was applied in place of the bias voltage to sleeve 202. The results were that the image was lacking in sharpness, low in density and it had, however, no fog.

COMPARATIVE EXAMPLE 1-a

Figure 13:
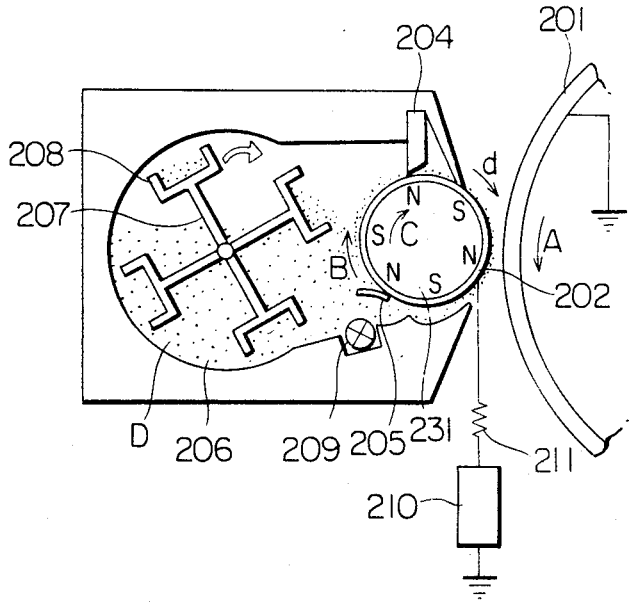
FIGS. 13 and 14 are schematic illustrations of the comparative examples of a developing method (an apparatus) relating to this invention.

A development was carried out by means of the developing unit illustrated in FIG. 13.

In this developing unit illustrated in the drawing, the developing roller and the developer reservoir were so arranged as not to satisfy the relation of $0 \leqq |\phi| < 90°$ in which angle $\phi$ was made between the vertical line and the normal line on the surface of the developing roller rotated in the course of conveyance from the trailing end of the developer supplying area on the developing roller to the developing area where toner was developed after reaching the surface registered thereon with an electrostatic latent image; and this unit was somewhat different from that illustrated in FIG. 9, in the configuration of the outer frame which was so designed as not to come into contact with the image carrier and not to spill the developer. Except the difference described above, the copies were obtained under the substantially same conditions as those in Example 1-a, and the results were that fog was casted over the non-image areas and all tints were produced everywhere, regardless of non-image areas or image areas, that was not desired.

COMPARATIVE EXAMPLE 1-b

Copies were obtained under the same conditions as those in Comparative Example 1-a, except that only a D.C. voltage component was applied to sleeve 202, in place of the bias voltage. The results were that the obtained image was low in density and poor in sharpness, and in addition blurs were produced and fog was also seen in non-image areas.

EXAMPLE 2-a

Resin-coated globular particles of insulation ferrite whose average particle size was 30 μm; magnetization ratio was 70emu/g; and resistivity was not lower than $10^{14}\Omega$cm were used as the carrier particles, and non-magnetic particles whose average particle size was 5 μm were used as the toner particles. A development was carried out by means of the device illustrated in FIG. 11, under the conditions that the proportion of the toner particles of developer D in developer reservoir 206 was 50% by weight to the carrier particles. (i.e., the toner concentration was 33.3%).

In this case, the other conditions were that the conditions of image carrier 201 were the same as those in Example 1; the outer diameter of sleeve 202 was 30 mm too however the number of revolution thereof was 150 rpm; the magnetic flux of the magnetic pole opposite to developing area A of magnet-containing body 333 was 1200 gauss; the thickness of the developer layer laid on the sleeve was 0.5 mm, i.e., 500 μm; and the space between sleeve 202 and image carrier 201 was 1.0 mm, i.e., 1000 μm; and the bias voltage component applied to sleeve 202 was −150 V and the A.C. voltage component was 3 kHz, 1200 V. Brush 212 was revolved in opposite direction to the direction of conveying developers.

A development was carried out under the abovementioned conditions and thus developed image was transferred to a sheet of plain paper and was then fixed by means of a heat-roller type fixing device at the surface temperature of 140° C. The resultantly obtained image was found therein neither edge-effect nor fog and high in density and excellent in sharpness and clarity. In succession, 50,000 copies were obtained in which every stable and invariable image was obtained from the begining to the end.

EXAMPLE 2-b

Figure 14:
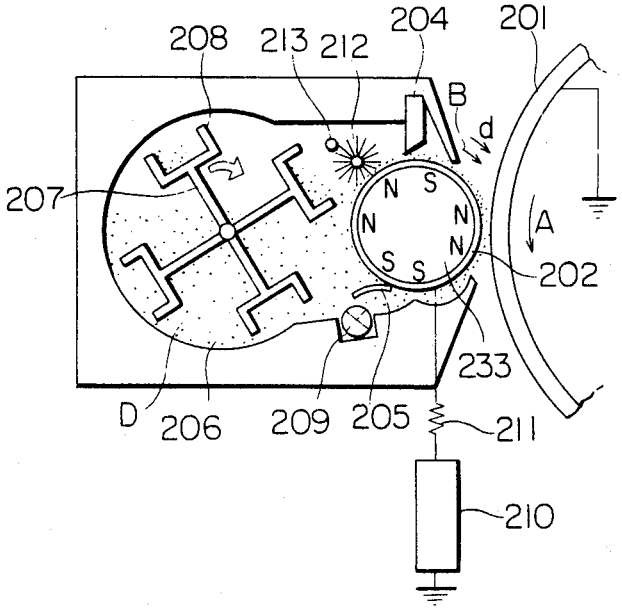

A development was tried by making use of the developing unit illustrated in FIG. 14.

In this developing unit, toners are developed in the course where the toners are conveyed from trailing end R-a of the area on a developing roller whereto developers are supplied, to the surface registered with an electrostatic latent image. The developing roller and the developer reservoir were so arranged as not to satisfy the relation of $0 \leqq |\phi| < 90°$ in which angle $\phi$ made between a vertical line and the normal line on the surface of the developing roller in the course of conveyance to the developing area, and the bucket was so arranged as to dust the developer over the sleeve. The outer frame 214 of the developing device was slightly different in configuration from that shown in FIG. 11, so that the outer frame cannot come into contact with the image carrier and developer cannot spill.

Copies were obtained under substantially the same conditions as those in Example 2-a, except the abovementioned arrangements. The results obtained were that the copies were excellent though some fogs were casted over them.

The table below summarizes the other Examples 2-c through 2-e of which basic construction were the same as those of Examples 2-a and 2-b;

| Example | Conditions | Effects |
|---|---|---|
| 2-a | The same conditions applied as those in Example 2-a, except that brush 212 was eliminated | The effects were almost the same as those obtained in Example 1-a. |
| 2-d | The same conditions applied as those in Example 2-a, except that the bias voltage applied to sleeve 202 was only a D.C. component. | The image obtained were lacking in sharpness and somewhat low in density, but no fog was found. |
| 2-e | The same conditions applied as those in Example 2-b, except that the bias voltage applied to sleeve 202 was only a D.C. component. | The images obtained were lacking in sharpness and somewhat low in density, but the fog was as much as that in Example 2-b. |

COMPARATIVE EXAMPLE 2-a

Copies were obtained under the same conditions as in Example 2-b, except that brush 212 was eliminated. The result was that uneven tints were found in all the areas regardless of non-image areas and image areas, that was ineligible.

COMPARATIVE EXAMPLE 2-b

Copies were obtained under the same conditions as in Example 2-b, except that brush 212 was eliminated and the bias voltage applied to sleeve 202 was replaced by only the D.C. voltage component. The results were that the images obtained were low in density and poor in sharpness, and that fog was casted thereover and uneven tints were found.

The abovedescribed invention originated with the present inventor who discovered that there can hardly be affected by the variations of toner concentration in the developing methods wherein a two-component type developer comprising toners and carriers is used and an image forming body is not brought into contact with a developer layer laid on a sleeve.

Further, based on another discovery that the density of an image developed is readily adjustable for compensating the variations of toner concentration, the first developing method of this invention was devised by neatly combining the two discoveries with each other. According to the developing methods relating to this invention, it is not needed to adopt such a troublesome means as those in the conventional methods that toners must constantly be replenished as much as consumed to developer comprising carriers and toner stored in a developer reservoir, but it is possible to enjoy such an excellent effect on obtaining a very large quantity of recorded images without having any fog which are excellent in stability, reproductivity and sharpness.

In the second developing method of this invention, it is possible to obtain images having very few fogs despite the high toner concentration in a developer supplying section, because developer containing an excessive amount of toners is supplied to the developer supplying section and the toner concentration of the developer is reduced in a conveying process so as to make the concentration nearly proper in a developing area.

Further, in this invention, the thickness of the developer rested on the sleeve is made thinner than the space between the surface of the sleeve and the surface of the image carrier, and a vibration electric field is applied to the space between the surfaces. It is therefore possible to obtain images having an excellent sharpness and few fogs, even though the abovementioned reduction of the toner concentration is not fully satisfied.

Any one of the developing methods of this invention may be applied not only to a recording apparatus including, for example, an electrophotographic copier, but also to a recording apparatus of an electostatic recording system or of a magnetic recording system.

What is claimed is:

1. An image forming apparatus for developing an electrostatic latent image on a photreceptor by flying toner particles held in a layer of developer through a space existing between the layer and the photoreceptor at a developing area comprising a conveying means for conveying the developer to the developing area, said conveying means comprising a magnetic means for generating magnetic force to support the developer on a surface of the conveying means, a detecting means for detecting a toner concentration, an adjusting means for adjusting at least one of the developing conditions in response to the detected toner concentration, a means for supplying the developer to the conveying means at a supplying position, whereby the developer supplied by said means is conveyed to the developing area through a removing area where the excessive toner particles are removed from the developer under the influence of gravity, and a regulating means for regulating the thickness of the layer, said regulating means being arranged at a regulating position between the developing position and the supplying position.

2. The apparatus of claim 1 wherein said magnetic means is a plurality of magnetic poles arranged inside of the conveying means.

3. The apparatus of claim 2 further comprising an auxiliary menas for removing the excessive toner particles, said auxiliary means being arranged between said supplying position and said regulating position.

4. A developing method for developing an electrostatic latent image on an image forming surface comprising the steps of forming a layer of developer containing toner particles on a conveying means, the thickness of said layer being smaller than a space existing between the image forming surface and the conveying means, conveying the layer through a developing area, applying an alternating bias voltage between the image forming surface and the layer at the developing area, detecting a toner concentration of the developer, adjusting at least one developing condition in response to the detection of the toner concentration so that an image density is kept substantially constant despite a change of the toner concentration.

5. The developing method of claim 4 wherein the developing condition is frequency of the alternating bias voltage, value of the alternate bias voltage, voltage of the latent image, or speed of the conveying means.

6. The developing method of claim 4 wherein said developer is conveyed by rotating both of a non-magnetic sleeve and a plurality of magnetic poles arranged in the sleeve.

7. The developing method of claim 6 wherein the developing condition is frequency of the alternating bias voltage, value of the alternate bias voltage, voltage of the latent image, speed of the sleeve, or speed of the magnetic poles.

8. The developing method of claim 4 wherein the developer comprises the toner particles and magnetic carrier particle.

9. The developing method of claim 8 wherein an average size of the carrier particles is from 5 to 50 $\mu$m and an insulation property of the carrier particles is not less than $10^8\Omega$cM, an average size of the toner particles is from 7 to 20 $\mu$m, and a proportion of the toner particles is from 10 to 40% by weight based on the total weight of the developer.

10. A developing method for developing an electrostatic latent image on a image forming surface comprising the steps of forming a layer of developer containing toner particles on a conveying means, a thickness of said layer being smaller than a space existing between the image forming surface and the conveying means, conveying the layer through a developing area flying the toner particles to the image forming surface detecting a toner concentraction of the developer, adjusting at least one developing condition in response to the detection of the toner concentration so that an image density is kept substantially constant despite a change of the toner concentration.

11. The developing method of claim 10 wherein said developer is conveyed by rotating both of a non-magnetic sleeve and a plurality of magnetic poles arranged in the sleeve.

12. The developing method of claim 10 wherein the developer comprises the toner particles and magnetic carrier particles.

13. The developing method of claim 12 wherein an average size of the carrier particles is from 5 to 50 $\mu$m and an insulation property of the carrier particles is not less than $10^8\Omega$cM, an average size of toner particles is from 7 to 20 $\mu$m, and a proportion of the toner particles is from 10 to 40% by weight based on the total weight of the developer.

14. The developing method of claim 11 wherein the developing condition is voltage of the latent image, speed of the sleeve, or speed of the magnetic poles.

* * * * *